United States Patent [19]

Kido et al.

[11] Patent Number: 4,660,389

[45] Date of Patent: Apr. 28, 1987

[54] CEILING-CONCEALMENT TYPE AIR CONDITIONING APPARATUS

[75] Inventors: Hitoshi Kido; Yoshinobu Igarashi; Junji Okabe, all of Wakayama, Japan

[73] Assignee: Mitsubishi Denki Kabushiki Kaisha, Tokyo, Japan

[21] Appl. No.: 792,774

[22] Filed: Oct. 30, 1985

[30] Foreign Application Priority Data

Nov. 2, 1984 [JP] Japan ..... 59-167038[U]

[51] Int. Cl.[4] ..... F25D 19/00

[52] U.S. Cl. ..... 62/298; 62/263

[58] Field of Search ..... 62/263, 259.1, 298; 165/48.1, 48.2

[56] References Cited

U.S. PATENT DOCUMENTS 4,458,502 7/1984 Adachi et al. ..... 62/263

FOREIGN PATENT DOCUMENTS 57-35769 1/1978 Japan .

1381600 1/1975 United Kingdom ..... 62/263

*Primary Examiner*—Henry A. Bennet

*Attorney, Agent, or Firm*—Oblon, Fisher, Spivak, McClelland & Maier

[57] ABSTRACT

An air blower chamber includes a partition plate provided with an air intake opening, an air blower mounted on the partition plate so as to be detachable from the same through the air intake opening, a box for auxiliary parts and an air filter placed at an inlet opening of said main body. An air intake panel is detachably fitted to an opening of a ceiling which is spaced apart from and below the inlet opening and an air intake chamber for connecting the inlet opening to the opening of the ceiling. Accordingly, inspection and services for blades and the motor of a blower, auxiliary parts and air filter can be easily made by simply detaching the air intake panel without necessity of a worker to enter in the ceiling.

4 Claims, 10 Drawing Figures

FIGURE 3 *PRIOR ART*
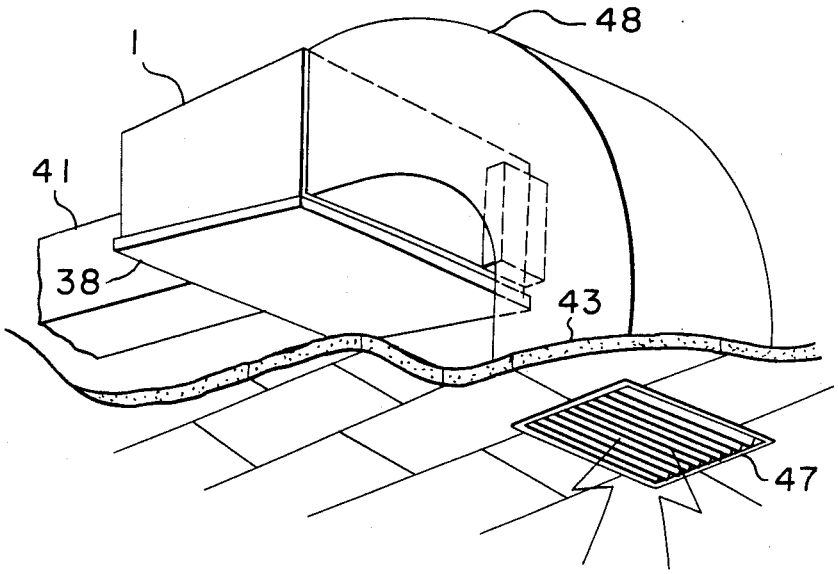
FIGURE 4 *PRIOR ART*
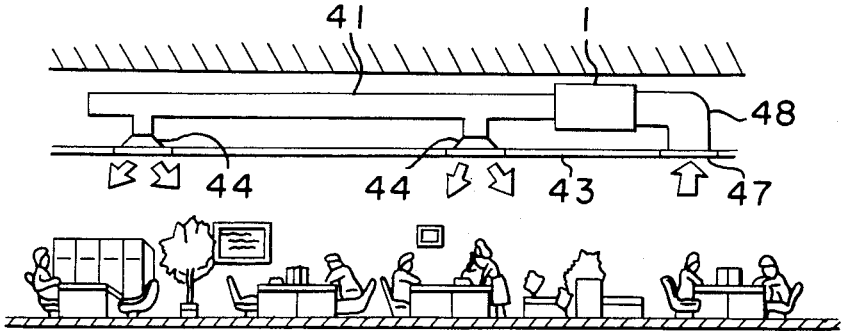

CEILING-CONCEALMENT TYPE AIR CONDITIONING APPARATUS

BACKGROUND OF THE INVENTION

The present invention relates to a ceiling-concealment type air conditioning apparatus installed at the indoor side of a room. More particularly, it relates to construction of such an apparatus for facilitating work for maintenance of the same.

FIG. 1 is a schematic view of a conventional ceiling-concealment type air conditioning apparatus.

In FIG. 1, a reference numeral 1 designates a main body of a ceiling-concealment type air conditioning apparatus.

A numeral 20 designates a heat exchanger, a numeral 9 designates a box for auxiliary parts, a numeral 12*a* designates an air blower, a numeral 12 designates a motor for the air blower, a numeral 18 designates an air filter for preventing clogging of the heat exchanger 20, a numeral 38 designates a drain pan for receiving drops of water condensed on the heat exchanger 20 and the air conditioning apparatus main body 1, a numeral 41 designates a blowing duct for feeding cooling or warming wind at a suitable position in a room, a numeral 43 designates a ceiling, a numeral 46 designates a casing for the air blower, and a numeral 45 designates an inspection hole through which the ceiling-concealment type air conditioning apparatus installed in the ceiling 43 can be inspected.

FIG. 2 is a diagram showing the servicing for the conventional air conditioning apparatus and FIG. 3 is a schematic view showing the conventional ceiling-concealment type air conditioning apparatus with an intake duct installed on the ceiling. In FIG. 3, an air intake grill 47 is formed in the ceiling 43 to suck air in the room into the air conditioning apparatus through an intake duct 48.

FIG. 4 is a diagram showing how the conventional ceiling-concealment type air conditioning apparatus is installed on the ceiling, wherein a reference numeral 44 designate discharge ports for blowing out the cooling or warming wind into the room.

The operation of the conventional air conditioning apparatus will be described.

In FIG. 1, air to be heat-exchanged is sucked from the rear part of the ceiling-concealment type air conditioning apparatus 1 through the air filter 18. The air is heat-exchanged while it is passed through the heat exchanger 20 to become cooling or warming air. The cooling or warming air is supplied to the inside of the room through the discharge duct 41 by means of the air blower 12*a* comprising the motor 12 and blades (not shown).

In the conventional air conditioning apparatus, services on parts to be put in the box 9 is carried out through the inspection hole 45 formed in the ceiling 43, the inspection hole 45 being formed near the air conditioning apparatus. When service on the motor 12 of the air blower, drain pan 38 and so on is carried out, a worker has to enter in the ceiling as shown in Figure 2.

In FIG. 3, air to be heat-exchanged is sucked into the ceiling-concealment type air conditioning apparatus 1 through the air intake grill 47 formed in the ceiling 43 through the intake duct 48, and is fed through the discharge duct 41 as in the embodiment shown in FIG. 1. The air is finally blown in the room through a single or a plurality of discharge ports 44 to perform air-conditioning.

Although the conventional ceiling-concealment type air conditioning apparatus has an advantage of providing good air flow distribution in the room because the discharge ports 44 are provided apart from the air intake grill 47 as shown in FIG. 4, there is inconvenience that maintenance for the motor 12 for the blower, blades is carried out from a side surface of the air conditioning apparatus 1 but not from the lower surface because the space of the inner side of the ceiling is generally narrow. Accordingly, a worker has to enter in the inner side of the ceiling for maintenance of the apparatus. The maintenance work done in the ceiling is very difficult because the inside of the ceiling is dark; there are many obstacles such as beams, wiring, piping, ducts and so on, and the construction of the ceiling is not so strong, so that the worker is in an unstable condition.

Further, when an intake duct is to be provided at the room side, an intake duct 48 has to be individually designed in accordance with a positional relation between the air intake grill 47 formed in the ceiling 43 and the air conditioning apparatus 1.

SUMMARY OF THE INVENTION

It is an object of the present invention is to eliminate the disadvantages of the conventional air conditioning apparatus and to provide a ceiling-concealment type air conditioning apparatus of a lower manufacturing cost and enabling maintenance to be easy.

The foregoing and the other objects of the present invention have been attained by providing a ceiling-concealment type air conditioning apparatus which comprises an air conditioning apparatus main body having an air blower chamber which includes a partition plate provided with an air intake opening, an air blower mounted on the partition plate so as to be detachable from the same through the air intake opening, a box for auxiliary parts and an air filter placed at an inlet opening of the main body, and heat exchanging chamber containing a heat exchanger which performs heat-exchange between a heat transfer medium and air to be heat-exchanged fed from the air blower; an air intake panel detachably fitted to an opening of a ceiling which is spaced apart from and below the inlet opening of the main body; and an air intake chamber for connecting the inlet opening of the main body to the opening of the ceiling so as to form an air passage for feeding air to be heat-exchanged which is sucked from the air blower.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein:

FIG. 3 is a perspective view partly broken of the conventional air conditioning apparatus with an intake duct installed in the ceiling;

FIG. 4 is a diagram showing a state of use of the conventional ceiling-concealment type air conditioning apparatus;

DETAILED DESCRIPTION OF THE PREFERRED EMBODIMENTS

A preferred embodiment of the present invention will be described with reference to drawing.

Figure 1:
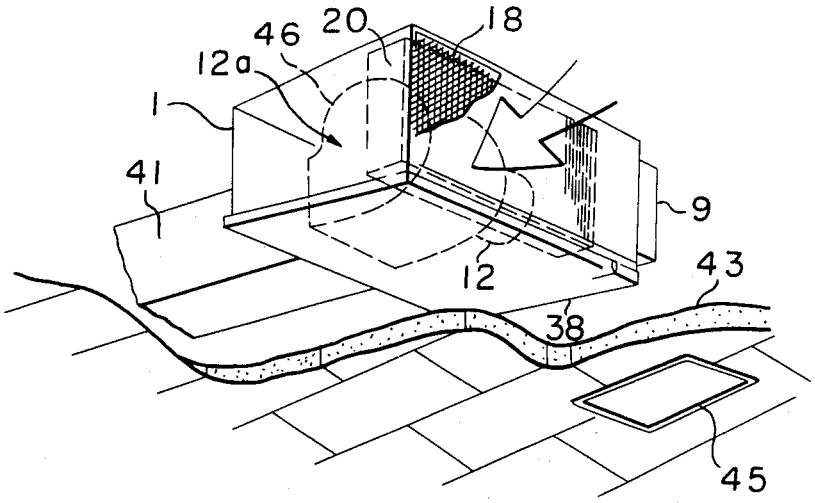
FIGURE 1 PRIOR ART
FIG. 1 is a schematic view of a conventional ceiling-concealment type air conditioning apparatus.
Figure 2:
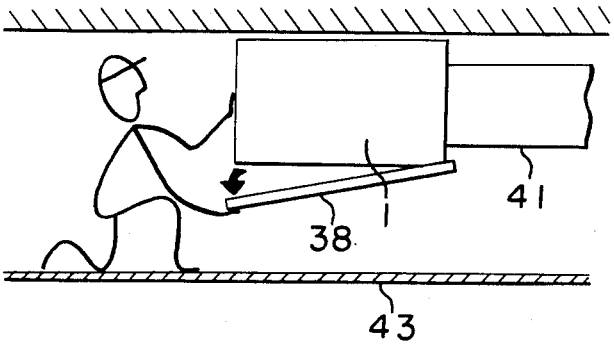
FIGURE 2 PRIOR ART
FIG. 2 is a diagram showing work for maintenance of the conventional air conditioning apparatus.
Figure 5:
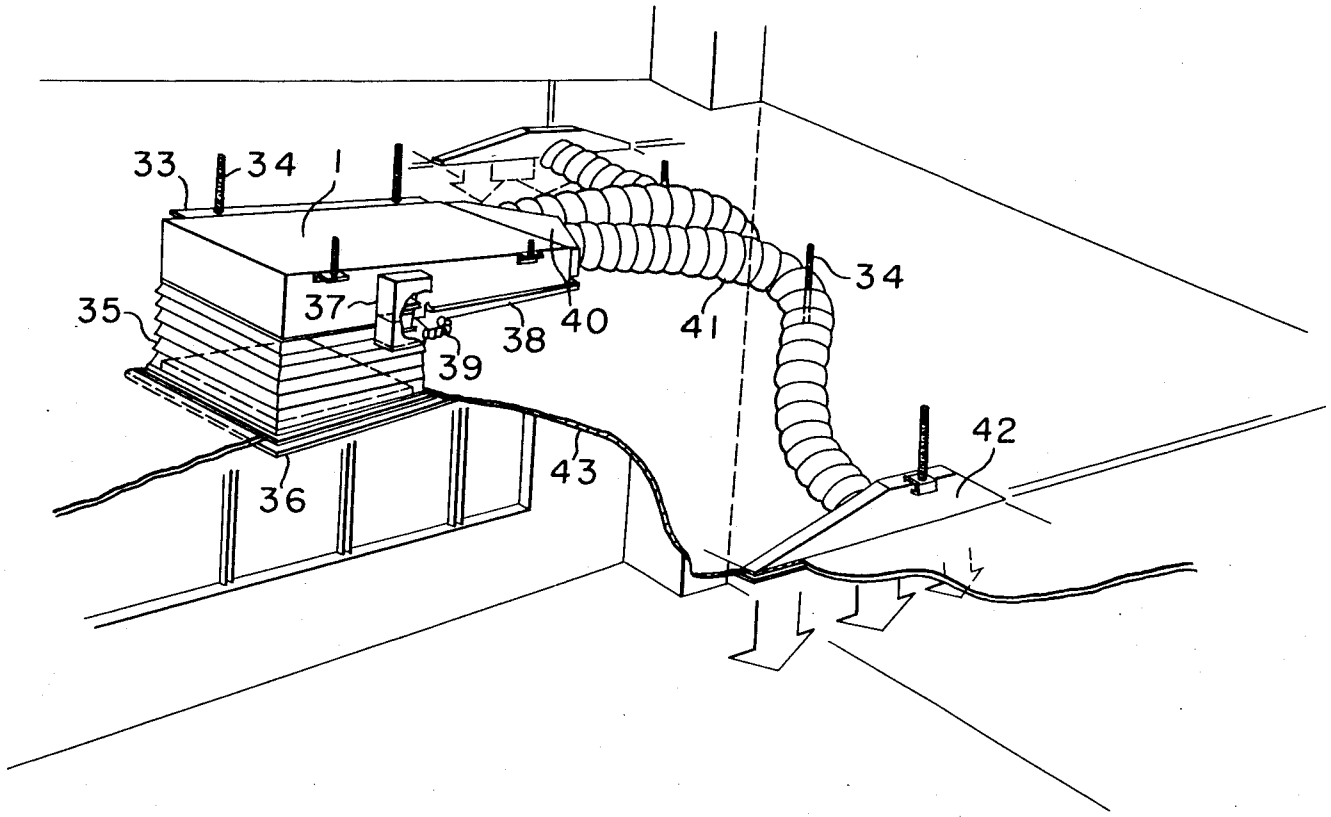
FIG. 5 is a schematic view partly broken of an embodiment of the ceiling-concealment type air conditioning apparatus of the present invention.
Figure 6:
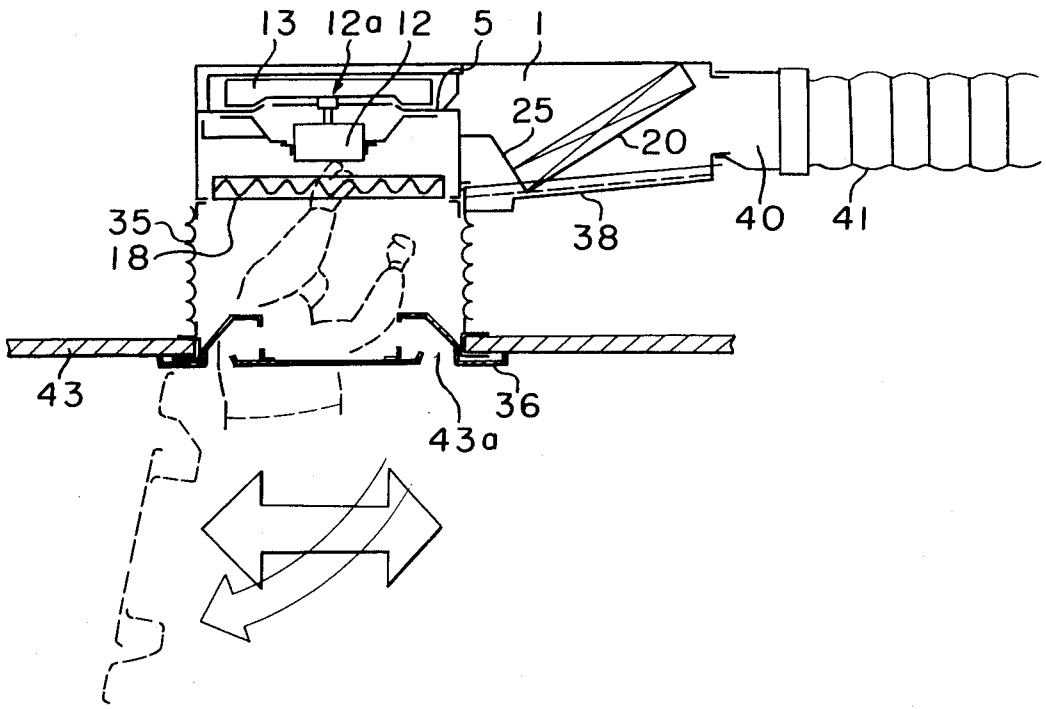
FIGS. 6 and 7 are respectively diagrams showing maintenance of the air conditioning apparatus shown in FIG. 5.
Figure 7:
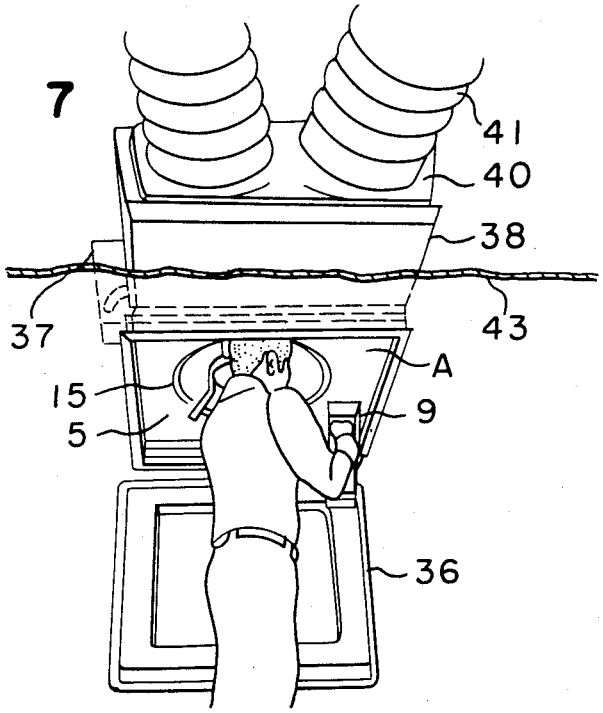

In FIGS. 5 to 7, the same reference numerals designate the same or corresponding parts. The ceiling-concealment type air conditioning apparatus main body 1 is provided with a suspension means at the upper side portions, the suspension means comprising fitting brackets 33 and suspension bolts 34 for suspending the main body 1 from a supporting beam or so on. The air conditioning apparatus main body 1 is placed in a space above the ceiling 43. An air intake chamber 35 of a bellows type is attached to the lower part of the main body 1 so as to surround an inlet opening of the main body. The other end of the bellows type air intake chamber 35 is connected to the ceiling 43 in which an opening of the ceiling 43 is formed. An air intake panel 36 is detachably attached to the lower part of the ceiling 43 to cover the opening of the ceiling. The air intake panel 36 may be attached to the ceiling by means of a hinge. The main body 1 is provided with a drain pump 37 for increasing drain height, a drain pan 38 and a drain can 39 for introducing drain water stored in the drain pan 38 to the drain pump 37. A discharge chamber 40 is connected to the main body 1 to divide cooling or warming air blown from the main body into two air-flows. Two discharge ducts 41 are connected to the discharge chamber 40 to feed the cooling or warming air to breezeline type discharge ports 42.

Particularly, in FIGS. 6 and 7 showing how to carry out maintenance work for the ceiling-concealment type air conditioning apparatus of the present invention, a partition plate 5 is horizontally placed inside an air blower chamber (A) to divide the chamber into upper and lower sections and the air blower 12*a* is attached to the partition plate 5 so that it can be removable from the air blower chamber (A) through an air intake opening formed in the partition plate 5. A reference numeral 9 designates a box for auxiliary parts attached to the partition plate 5 at the upstream side of an air-flow, a numeral 13 designates blades such as a sirocco fan and a numeral 15 designates a bellmouth for the air blower which is also attached to the partition plate 5.

Figure 8:
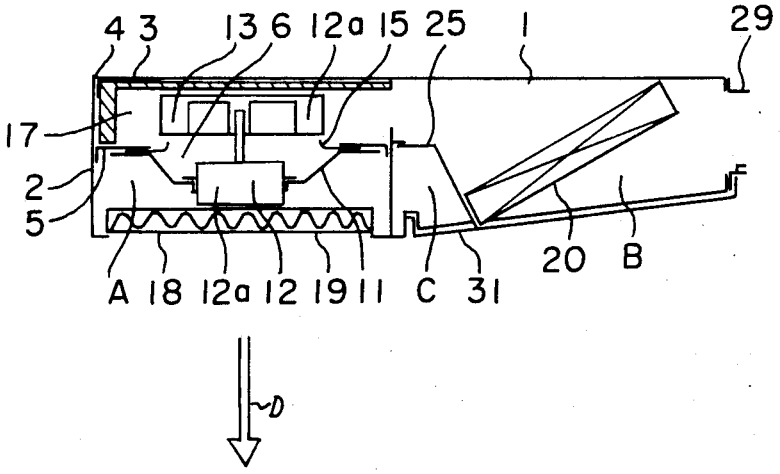
FIG. 8 is a longitudinal cross-sectional view of a main body of the air conditioning apparatus shown in FIG. 1.
Figure 9:
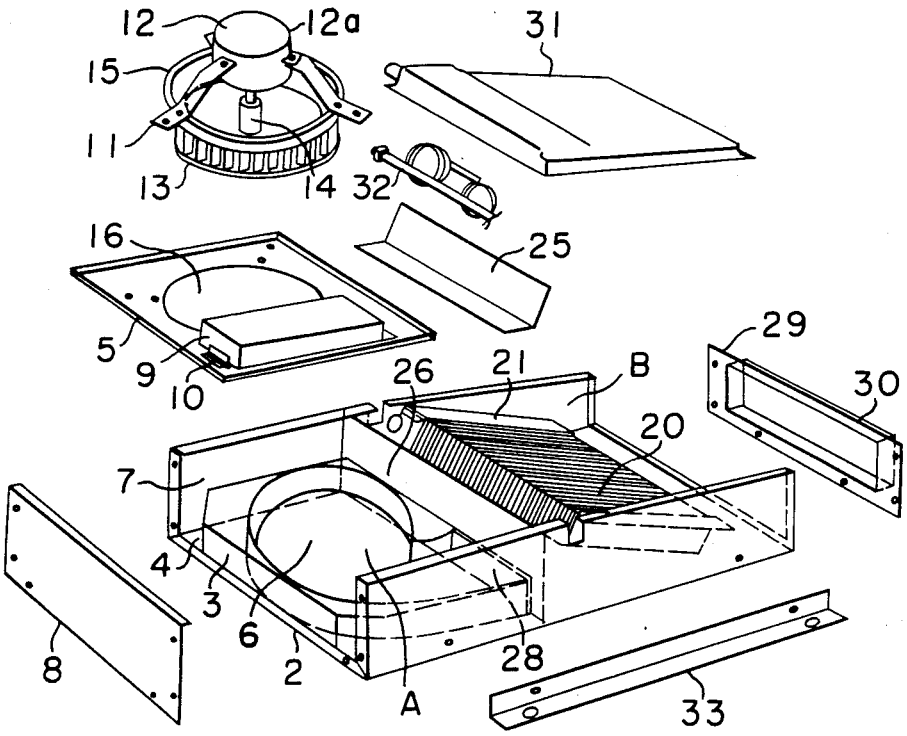
FIG. 9 is a schematic view of the air conditioning apparatus in a disassembled state.

The detailed explanation will be made as to the air conditioning apparatus main body of the present invention with reference to FIGS. 8 and 9. The ceiling-concealment type air conditioning apparatus main body 1 generally comprises an air blower chamber (A), a heat exchanging chamber (B) and a choking device chamber (C). A frame 2 as an outer shell is formed by bending the front and rear ends and the right and left ends of a thin metal plate into a generally channel-form in cross section. A casing 3 for providing an air-flow path 17 is formed as an integrally molded product of, for instance, styrol. The casing 3 is placed between the inner surface 4 of the frame 2 and the partition plate 5 so that the partition plate 5 extends over the opening part 6 of the casing 3 to form the air-flow path 17. The partition plate 5 is formed by bending a thin rectangular or square plate at the four edge portions in the same direction and the partition plate is then, secured to the inner side surface 7 of the frame 2 at the bent portions. A side plate 8 is secured to a bent portion of the frame 2 and the bent portions of the partition plate 5 by means of screws The box 9 for auxiliary parts in a rectangular prism form is hinged to the partition plate 5 by a hinge 10 in the lower section of the air blower chamber (A) so that it can be swung by a given angle around the supporting point of the hinge 10.

The air blower 12*a* is fixed to the partition plate 5 in a such a manner that the motor 12 is in the lower section of the air blower chamber (A) and is supported by the partition plate 5 by means of legs 11. Blades such as a sirocco fan which is connected to the shaft of the motor 12 by setting screw 14 is placed in the upper section of the air blower chamber (A). The bellmouth is provided at the air intake side of the sirocco fan and is attached to the partition plate 5 together with the legs 11 or the air blower 12*a*. The air intake opening 16 is formed at the central part of the partition plate 5 and has an inner diameter (for instance, 20 mm) which is greater than the outer diameter of the sirocco fan 13. Accordingly, the air blower 12*a* can be easily removed in the direction of an arrow mark (D) from the air blower chamber (A) without necessity of releasing the setting screw 14 which connects the blades to the motor 12. The air filter 18 is provided at the inlet opening 19 of the main body to prevent dust from entrance into the air conditioning apparatus.

Figure 10:
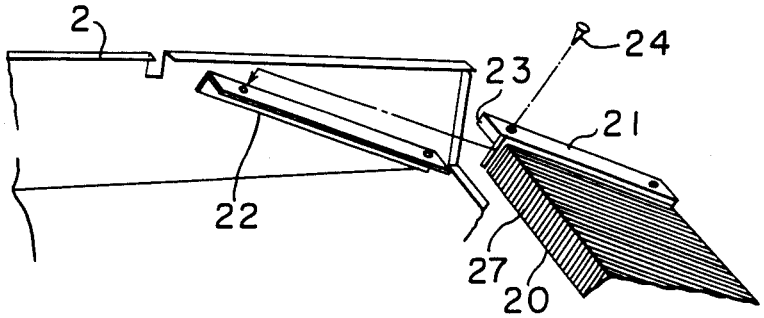
FIG. 10 is a schematic view of elements for fitting a heat exchanger in a disassembled state of the air conditioning apparatus of the present invention.

The construction of the heat exchanging chamber (B) is described with reference to FIGS. 8 to 10. A reference numeral 20 designates a plate fin type heat exchanger for performing heat-exchange between a heat transfer medium and air to be heat-exchanged supplied by the air blower 12*a*. The heat exchanger 20 is provided with L-shaped tubular plates 21 at the right and left sides. On the other hand, a pair of L-shaped fitting plates 22 made of relatively thin metal plate is attached to both inner side surfaces of an extending portion of the frame by screws or welding in a slanted condition. Accordingly, the heat exchanger 20 is secured to the main body 1 in such a manner that the tubular blades 21 at both sides of the heat exchanger 20 are put on the fitting plates 22; the heat exchanger 20 is caused to slide along the fitting plates 22 until the bent portions 23 formed at one end of the tubular plate 21 come to contact with the respective one end of the fitting plates to thereby determine its position, followed by fastening it by screws 24. A guide plate 25 is fitted between a shielding plate 26 for dividing the frame 2 into the air blower chamber (A) at the front section and the heat exchanging chamber (B) at the rear section and the surface of fins of the heat exchanger 20, whereby an airflow passage is formed in association with the frame 2 without causing leakage of air to be heat exchanged which is fed from the air-flow path 17 through an apeature 28. The air passed through the passage is introduced in the heat exchanger 20 where it is heat-exchanged to be cooling air or warming air. A reference numeral 29 designates a discharge duct flange provided with a flange portion 30 which facilitates fitting of the discharge duct at a field for installation. A numeral 31 designates a drain pan formed by bending a steel plate or by molding a resinous material. The drain pan 31 collects drops of water produced on the outer surface of the heat exchanger 20 and the frame 2 during cooling operation, and drains the water. The drain pan extends at the lower part of the frame 2, the discharge duct flange 29 and the shielding plate 26, and defines the heat exchanging chamber (B) and the choking device chamber (C) by the contact of the lower edge of the guide plate 25 with the inner surface of the drain pan 31.

The construction of the choking device chamber (C) will be described. A reference numeral 32 designates a choking device for cooling or warming which may be any combination among a tube of cupper, a check valve, a capillary tube, an electromagnetic valve and so on. The choking device 32 is placed in the choking device chamber (C) which is formed by the shielding plate 25, the guide plate 25 and the drain pan 31 extending to the lower part of them.

Thus, the sirocco fan 13 of a bottom sucking type, the motor 12, the box 9 for auxiliary parts and air filter 18 are concentrated in the air blower chamber A in the ceiling-concealment type air conditioning apparatus main body 1. Further, the air intake panel 36 is detachably attached to the opening 43*a* of the ceiling 43 just below the air intake opening 19 of the air blower chamber (A). Accordingly, inspection and maintenance for the air filter, the blades, the motor, the auxiliary parts can be easily carried out from the opening 43*a* formed in the ceiling by simply detaching the air intake panel 36 without necessity of a worker to enter in the ceiling. Accordingly, efficiency in maintenance can be remarkably improved.

We claim:

1. A ceiling-concealment type air conditioning apparatus which comprises:

an air conditioning apparatus main body having an air blower chamber which includes a partition plate provided with an air intake opening, an air blower mounted on said partition plate so as to be detachable from the same through said air intake opening, a box for auxiliary parts and an air filter placed at an inlet opening of said main body;

a heat exchanging chamber containing a heat exchanger which performs heat-exchange between a heat transfer medium and air to be heat-exchanged fed from said air blower;

an air intake panel detachably fitted to an opening of a ceiling which is spaced apart from and below said inlet opening of the main body; and an air intake chamber for connecting said inlet opening of said main body to said opening of the ceiling so as to form an air passage for feeding air to said air blower, wherein said partition plate is placed in the horizontal direction in said air blower chamber to divide the same into upper and lower sections, wherein said air blower comprises a motor and blades, and wherein said motor is in said lower section and is supported by said partition plate by means of legs and said blades are placed in said upper section.

2. A ceiling-concealment type air conditioning apparatus according to claim 1, wherein the inner diameter of said air intake opening of the partition plate is greater than that of the outer diameter of said blades.

3. A ceiling-concealment type air conditioning apparatus according to claim 1, wherein said air intake chamber is defined by a bellows type outer wall.

4. A ceiling-concealment type air conditioning apparatus according to claim 1, wherein said box for auxiliary parts is attached to said partition plate by a hinge in said lower section of the main body.

* * * * *